US005649383A

United States Patent [19]

Wesp et al.

[11] Patent Number: 5,649,383

[45] Date of Patent: Jul. 22, 1997

[54] BARREL RETAINING DEVICE FOR FIREARMS

[75] Inventors: Horst Wesp; Peter Dallhammer, both of Ulm, Germany

[73] Assignee: Carl Walther GmbH, Ulm, Germany

[21] Appl. No.: 609,781

[22] Filed: Apr. 1, 1996

[30] Foreign Application Priority Data

Mar. 7, 1995 [DE] Germany ..... 195 07 993.0

[51] Int. Cl.[6] ..... F41A 21/00

[52] U.S. Cl. ..... 42/75.01; 42/44; 42/70.06; 42/63; 42/75.04; 42/75.02

[58] Field of Search ..... 42/75.01, 44, 70.06, 42/63, 75.04, 75.02

[56] References Cited

U.S. PATENT DOCUMENTS

| | | | |
|---|---|---|---|
| 1,168,985 | 1/1916 | Whiting | 42/75.01 |
| 3,707,796 | 1/1973 | Bielfeldt | 42/70 C |
| 3,713,242 | 1/1973 | Seifried | 42/70 E |
| 3,728,810 | 4/1973 | Rohr | 42/69 |
| 4,574,510 | 3/1986 | Nishikawa | 42/40 |
| 4,646,457 | 3/1987 | Verney-Carron | 42/41 |
| 4,662,097 | 5/1987 | Walker | 42/44 |
| 5,165,383 | 11/1992 | Ebert et al. | 124/74 |
| 5,421,114 | 6/1995 | Bond et al. | 42/42.03 |

*Primary Examiner*—Charles T. Jordan
*Assistant Examiner*—Meena Chelliah
*Attorney, Agent, or Firm*—Edmund M. Jaskiewicz

[57] ABSTRACT

A barrel retaining device for an automatic pistol has a locking element that locks the pistol barrel and breech both of which are guided on the stock of the weapon. In order to remove the breech with the barrel from the stock in order to disassemble the pistol, the locking element has an actuating element on both sides of the stock which, when depressed, unlocks a lock between the barrel and the stock. At the same time, depressing of the actuation element releases the trigger finger into a forward position to impart a forward movement to a spring loaded trigger arm which is also cammed downwardly to disengage the trigger arm and the driver on the firing pin in the breech. The connections between the breech and the stock are thus released by a single unlocking movement when disassembling a pistol.

8 Claims, 3 Drawing Sheets

BARREL RETAINING DEVICE FOR FIREARMS

FIELD OF RELATED ART

The present invention relates to a structure for retaining a barrel on a firearm, more particularly, to an automatic pistol having on its stock a locking element for the firearm barrel and further having a breech which carries the weapon barrel and is operatively connected to the trigger by a driver of a firing pin slidably disposed in the breech.

BACKGROUND OF THE INVENTION

Known barrel retaining structures of this type are generally provided with a locking element and have been employed to make the connection between the firearm barrel placed in a breech and the stock of the pistol. In addition, there is generally an operating connection between the firing pin also disposed in the breech and a trigger arm located in the pistol stock and connected to the trigger. In order to disassemble the pistol, it is necessary to unlock these connections in order to enable the breech together with the barrel to be separated from the stock.

In DE-OS 22 46 346 there is disclosed an automatic pistol in which the barrel is provided with a downwardly-oriented hook that interacts with a control pin to unlock the connection between the barrel and the breech. On the front side of the barrel hook, there is a blocking nose that is engageable against the transversely positioned blocking bolt which is pivotally mounted in t he stock and prevents a further forward movement of the barrel and breech. The blocking bolt which is circular in cross section has a milled actuating surface such that in a particular torsional or pivoting position will release the blocking nose such that during a disassembly of the pistol the breech and barrel can be removed from the guide mechanism of the front portion of the stock. Initially, the breech is moved into its rearmost position against the force of the breech spring. Then the blocking bolt is pivoted into the unblocking position by means of an actuating element located on the outside of the pistol and connected to the blocking bolt. The breech is now released and can be moved forwardly so as to be separated from the stock.

In order to ensure that the cocked breech is not unintentionally propelled forwardly, the actuation element is automatically coupled with the breech catch device and is generally actuated by the empty magazine after the last cartridge has been fired. This will maintain the breech in the open position. As long as the disassembly lever is maintained in its actuated position, the breech catch device will remain in the catch position. When the disassambly lever is released, the breech catch under the action of a return spring will move into the release position so that the breech can be removed from the forward portion of the stock.

This prior art structure has the disadvantage that in order to disassemble the pistol, the breech must be pulled back manually against the force of its return spring and simultaneously, the blocking lever must be actuated. This actuation is complicated, time-consuming and requires a considerable amount of strength. Further, the coupling with the breech catch requires a relatively complex and expensive construction.

SUMMARY OF THE INVENTION

The principal object of the present invention is to provide a novel and improved structure for the removal of the breech when disassembling an automatic pistol.

It is another object of the present invention to provide such a structure which is simple in construction, reliable in operation and relatively easy to operate by the average person who might utilize the weapon.

The objects of the present invention are achieved and the disadvantages of the prior art structures are overcome by the present invention wherein there is provided a locking element having a stop for the trigger finger such that when the locking element is actuated in the unlocking direction, the spring-loaded trigger finger is released forwardly and the trigger arm which is connected with the trigger finger is guided downwardly so as to release the driver of the firing pin which in turn releases the breech.

According to one aspect of the present invention, an automatic pistol which has a breech at the rear portion of a barrel both of which are mounted upon a stock and there is a firing pin having a driver attached thereto mounted in the breech may be provided with a device for retaining a barrel on the pistol. A trigger on the stock is connected to a trigger arm and the trigger arm has a locking surface engageable with the driver on the firing pin. A locking element slidably mounted on the stock at the rear portion of the barrel is movable between locking and unlocking positions. The locking element has a stop which is engageable with the trigger when the locking element is in the locked position and is released from the trigger when the locking element is actuated downwardly to its unlocking position such that the trigger and trigger arm are released to move forwardly. Means are provided within the stock for camming the trigger arm downwardly when the trigger arm moves forwardly such that the driver of the firing pin is released from the locking surface of the trigger arm which in turn enables the breech and barrel to be released from the stock.

Such a structure considerably simplifies the removal of the breech during disassembly of the pistol and this removal can be performed in a very brief interval of time. The depressing of an actuation element of the single unlocking element will unlock the breech together with the barrel both of which are then released for removal from the stock. This same advantage also applies to the assembly of the breech since the locking of the barrel and breech is performed automatically when the breech is pushed on into position on the pistol stock.

BRIEF DESCRIPTION OF THE DRAWINGS

Other objects and advantages of the present invention will be apparent upon reference to the accompanying description when taken in conjunction with the following drawings, which are exemplary, wherein.

DETAILED DESCRIPTION OF THE PREFERRED EMBODIMENTS

Proceeding next to the drawings wherein like reference symbols indicate the same parts throughout the various views a specific embodiment and modifications of the invention will be described in detail.

Figure 1:
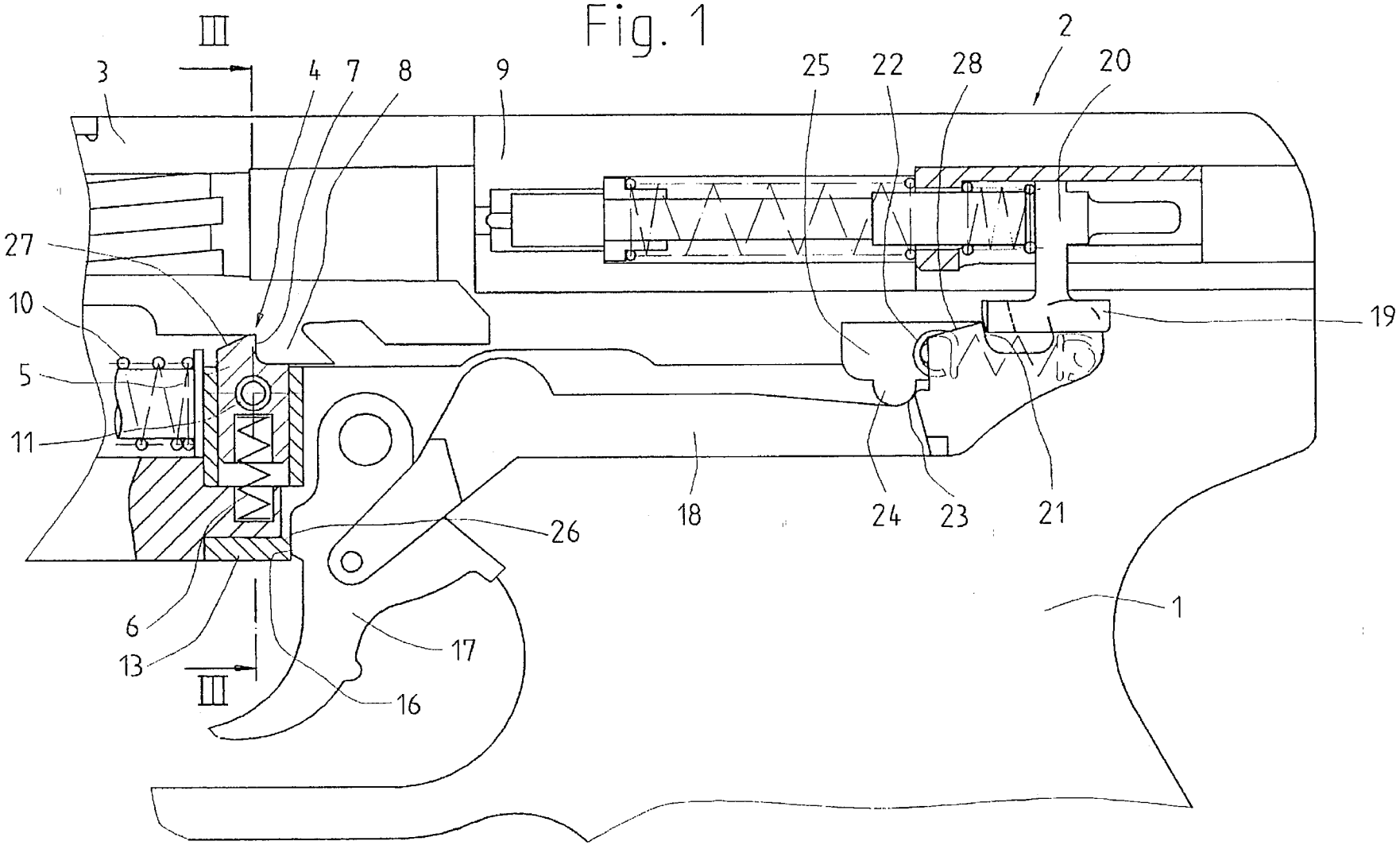
FIG. 1 is a side elevational view of an automatic pistol incorporating the present invention with portions thereof cut away and showing the components in the locked state.
Figure 2:
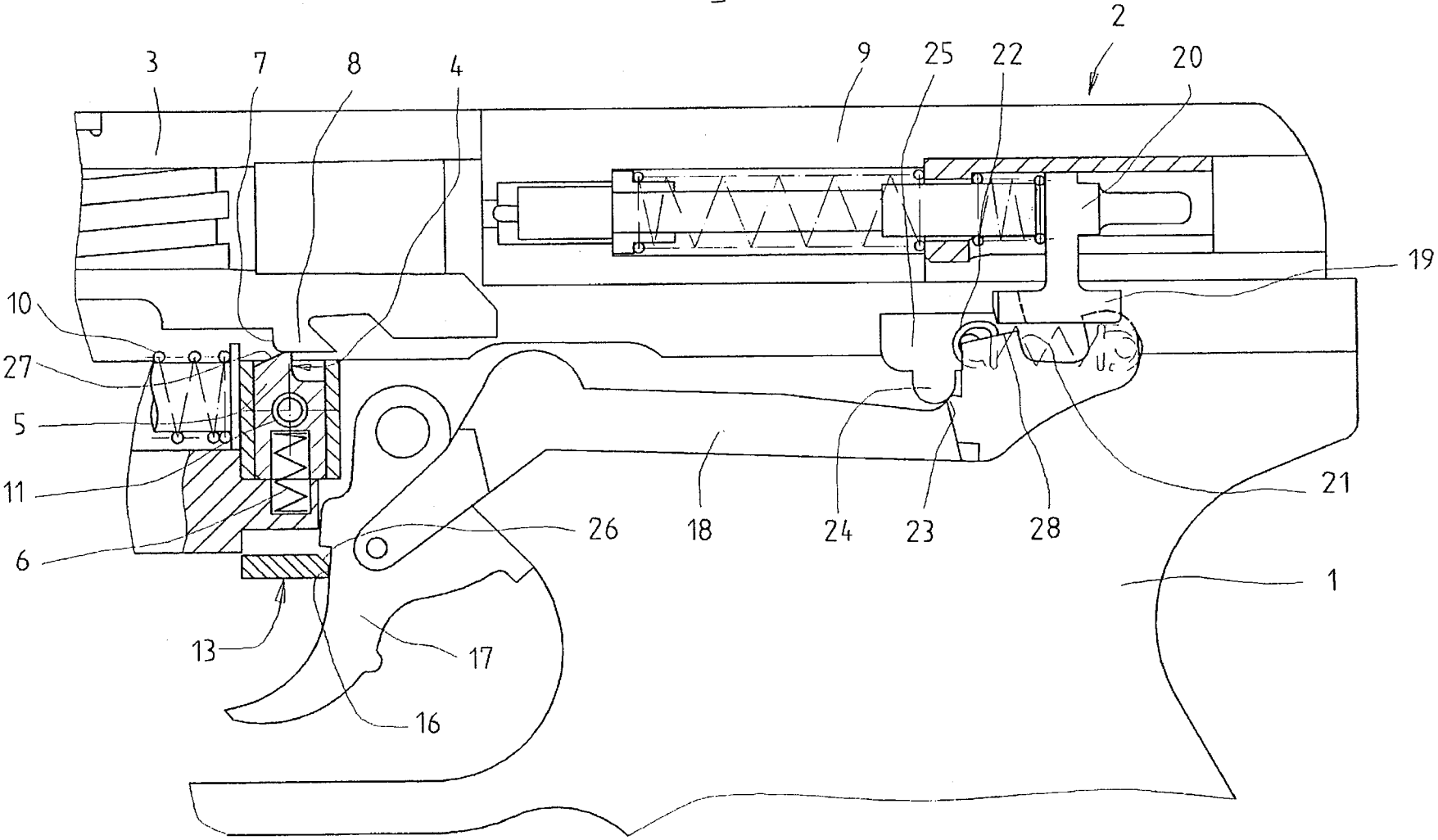
FIG. 2 is a view similar to that of FIG. 1 but showing the components unlocked for disassembly.

In FIG. 1 there is indicated generally at 2 an automatic pistol which incorporates the present invention and this pistol is provided with a stock 1 upon which is mounted a barrel 3 and in the rear portion of the barrel there is provided a locking element 4 which has a blocking bolt 5 vertically movable in the stock. A spring 6 resiliently maintains the blocking bolt 5 in its upper locking position as shown in FIG. 1. In this locking position, the blocking bolt 5 acts as a stop for a front edge 7 of a barrel hook 8 which extends downwardly from the barrel 3. As a result of this stopping action, the barrel 3 is prevented from any forward movement. The barrel 3 is received in a breech 9 that is slidable on the stock 1. The barrel hook 8 will function in a known manner to release the lock between the barrel 3 and the breech 9 after firing.

Figure 3:
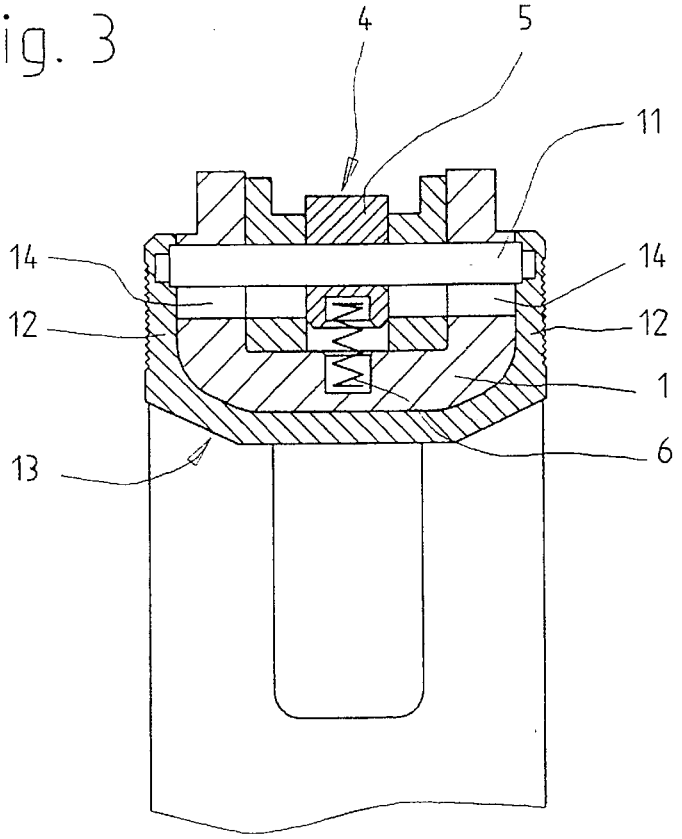
FIG. 3 is a sectional view taken along the lines III—III of FIG. 1.
Figure 4:
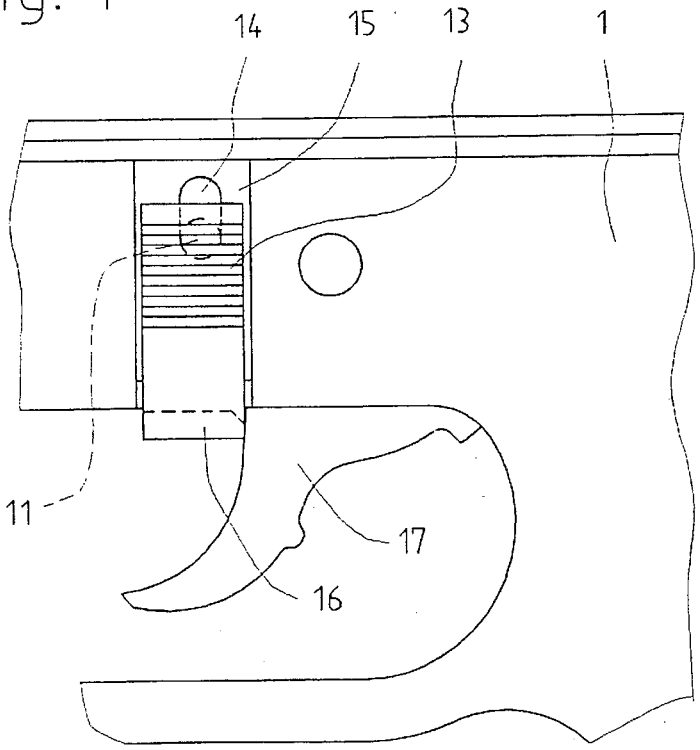
FIG. 4 is a side elevational view of a portion of the pistol of the present invention showing the locking element in its lowered unlocking position to permit disassembly of the pistol.

A breech spring 10 urges the breech 9 and barrel 3 forwardly against the blocking bolt 5. The blocking bolt 5 has a horizontally disposed guide bolt 11 that extends transversely to the direction of firing of the weapon and has its ends on both sides thereof seated within side shanks 12 of a U-shaped actuation element 13 as may be seen in FIG. 3. Further, both end portions of the guide bolt 11 pass through vertically oriented elongated openings 14 formed in the stock 1 and shown in FIGS. 3 and 4. The side shanks or legs 12 of the actuation element 13 are each guided in a vertical lateral recess 15 formed in the stock 11 such that by depressing the actuation element 13 downwardly the blocking bolt 5 can be moved vertically downwardly in the elongated holes 14 against the force of spring 6.

In the normal position as shown in FIG. 1, a cross piece or the base of the U-shaped actuation element 13 functions as a stop 16 for a trigger finger 17 which is mounted to pivot in stock 1 and is pivotally connected to a trigger arm 18. A driver 19 of uncocked firing pin 20 is positioned in the path of movement of a blocking surface 21 at the rear end portion of the trigger arm 18 which is pulled forwardly by a tension spring 22 and presses trigger finger 17 of the trigger against stop 16 of the actuation element 13. At the same time, trigger arm 18 is pulled upwardly by the tension spring 22 so that a control path 23 on the upper surface of the trigger arm 18 comes into contact with a control projection or cam 24 on trigger housing 25. This position of the trigger as illustrated in FIG. 1 is the starting position for the beginning of the double-action function of automatic pistol 2 and also for disassembing the pistol.

In order to disassemble the pistol, the actuation element 13 is moved downwardly manually so as to separate the blocking bolt 5 from the barrel hook 8. At the same time, stop 16 on the actuation element 13 moves downwardly to release trigger finger 17 which is then pressed forwardly by the trigger arm 18 under the force of the tension spring 22. During its forward movement, the trigger arm 18 is moved downwardly by cam 24 acting on control path 23 until locking surface 21 on the rear end portion of trigger arm 18 is moved out of the path of movement of driver 19 of the firing pin 20. Breech 9 can now be pulled forwardly and separated from the stock 1 of automatic pistol 2. After this removal of the breech 9, actuation element 13 automatically moves upwardly again under the force of spring 6. During this Upward movement, stop 16 on the actuation element 13 is provided with a cam surface 26 which will contact trigger finger 17. Accordingly, trigger finger 17 will be moved rearwardly together with trigger arm 18 into the starting position as shown in FIG. 1 since the spring 6 is constructed to be stronger and exert a greater force than tension spring 22.

When assembling the pistol, the barrel 3 is slid rearwardly on the stock such that barrel hook 8 will engage an inclined cam surface 27 on the upper end of the blocking bolt 5 which will thus cause the blocking bolt 5 to be moved downwardly until it engages the front edge 7 of barrel hook 8 from behind. The driver 19 of firing pin 20 also engages an inclined cam surface 28 on an upper surface of the rear portion of the trigger arm 18 to cause the trigger arm 18 to be moved downwardly. The lower surface of the driver 19 thus moves in a rearward direction across the cam surface 28 until the locking surface 21 of trigger arm 18 engages the driver 19 from behind and the trigger mechanism again assumes its starting position as shown in FIG. 1.

Thus it can be seen that the present invention has provided a simple yet reliable mechanism for retaining of a barrel on the stock of a firearm in such a manner as to facilitate the assembly and disassembly of the pistol.

It will be understood that this invention is susceptible to modification in order to adapt it to different usages and conditions, and accordingly, it is desired to comprehend such modifications within this invention as may fall within the scope of the appended claims.

What is claimed is:

1. A device for retaining a barrel for an automatic pistol having a stock, a barrel having a rear portion and a breech at said barrel rear portion mounted on said stock, a firing pin having a driver and mounted in said breech, a trigger on said stock and a trigger arm connected to said trigger, said trigger arm having a locking surface thereon engageable with said driver, a locking element slidably mounted on said stock at the rear portion of said barrel and having locking and unlocking positions a stop on said locking element engageable with said trigger when in the locked position and released from said trigger when said locking element is actuated to its unlocking position such that the trigger and trigger arm move forwardly, and means in said stock for camming said trigger arm downwardly when it is moved forwardly such that said driver of said firing pin is released whereby said breech and barrel are releaseable from said stock.

2. A device as claimed in claim 1 wherein said locking element is vertically slidable between its upper locking position and its lower unlocking position, a spring urging said locking element into its upper locking position, there being actuating elements on both sides of said locking element.

3. A device as claimed in claim 2 wherein said locking element comprises a blocking bolt, a guide bolt extending through said blocking bolt transversely to the direction of firing of the firearm and having end portions projecting outwardly of said blocking bolt, there being vertical elongated openings in said stock receiving said guide bolt end portions.

4. A device as claimed in claim 3 wherein said actuation elements comprise a U-shaped member having a base and a pair of legs, the ends of said guide bolt being seated in said legs, said base defining said stop engageable with said trigger.

5. A device as claimed in claim 4 wherein said actuation elements comprise a plastic material.

6. A device as claimed in claim 2 wherein there are lateral vertical recesses in said stock to receive slidably the actuation elements of said blocking element.

7. A device as claimed in claim 4 wherein the base of said locking element has a first cam surface thereon engageable with a portion of said trigger when said locking element is returned upwardly to its locked position.

8. A device as claimed in claim 3 wherein said blocking bolt has a second cam surface engageable with a portion of said breech during assembly of the firearm.

* * * * *